US005156652A

United States Patent [19]

Gregoli et al.

[11] Patent Number: 5,156,652

[45] Date of Patent: * Oct. 20, 1992

[54] LOW-TEMPERATURE PIPELINE EMULSION TRANSPORTATION ENHANCEMENT

[75] Inventors: Armand A. Gregoli, Tulsa; Andrew M. Olah, Broken Arrow, both of Okla.

[73] Assignee: Canadian Occidental Petroleum Ltd., Calgary, Canada

[ * ] Notice: The portion of the term of this patent subsequent to Feb. 16, 2005 has been disclaimed.

[21] Appl. No.: 449,994

[22] Filed: Dec. 13, 1989

Related U.S. Application Data

[63] Continuation of Ser. No. 938,630, Dec. 5, 1986, abandoned.

[51] Int. Cl.[5] ..... B01J 13/00; C10L 1/32

[52] U.S. Cl. ..... 44/302; 137/4; 137/13; 252/311.5; 252/312; 252/314; 252/351; 431/2

[58] Field of Search ..... 252/311.5, 312, 314, 252/351; 137/4, 13; 431/2; 44/302

[56] References Cited

U.S. PATENT DOCUMENTS

| | | | |
|---|---|---|---|
| 3,380,531 | 4/1968 | McAuliffe et al. | 166/371 |
| 3,410,794 | 11/1968 | Li | 208/308 |
| 3,425,429 | 2/1969 | Kane | 137/13 |
| 3,467,195 | 9/1969 | McAuliffe et al. | 166/371 |
| 3,491,835 | 1/1970 | Gagle | 166/305.1 |
| 3,519,006 | 7/1970 | Simon et al. | 137/13 |
| 3,572,354 | 2/1971 | Tinsley et al. | 137/13 |
| 3,670,752 | 6/1972 | Marsden, Jr. et al. | 137/13 |
| 3,756,794 | 9/1973 | Ford | 252/312 X |
| 3,785,620 | 1/1974 | Huber | 366/174 |
| 3,923,288 | 12/1975 | King | 366/336 |
| 3,943,954 | 3/1976 | Flournoy et al. | 137/13 |
| 4,099,537 | 6/1978 | Kalfoglon et al. | 137/13 |
| 4,108,193 | 8/1978 | Flournoy et al. | 137/13 |
| 4,152,290 | 5/1979 | Flournoy et al. | 252/355 |
| 4,239,052 | 12/1980 | McClaflin | 137/13 |
| 4,246,919 | 1/1981 | McClaflin | 137/13 |
| 4,249,554 | 2/1981 | McClaflin | 137/13 |
| 4,251,229 | 2/1981 | Naka et al. | 252/356 X |
| 4,265,264 | 5/1981 | Sifferman | 137/13 |
| 4,285,356 | 8/1981 | Sifferman | 137/13 |

(List continued on next page.)

FOREIGN PATENT DOCUMENTS

| | | |
|---|---|---|
| 556683 | 4/1958 | Canada . |
| 723145 | 12/1965 | Canada . |
| 756646 | 4/1967 | Canada . |
| 1147939 | 4/1969 | Great Britain . |
| 818432 | 7/1969 | Canada . |
| 853575 | 10/1970 | Canada . |
| 868151 | 4/1971 | Canada . |
| 879750 | 8/1971 | Canada . |
| 1023288 | 12/1977 | Canada . |
| 1103205 | 9/1981 | Canada . |
| 1113529 | 12/1981 | Canada . |
| 1117568 | 2/1982 | Canada . |

(List continued on next page.)

OTHER PUBLICATIONS

Down-Hole Emulsification for Improving Viscous Crude Production by Simon et al., 1968, Journal of Petroleum Technology.

Down Hole Water Injection Helps Pump Viscous Crude by Franco, 1966, Oil & Gas Journal.

The Flow Mechanism of Dilute, Stable Emulsions in Porous Media by Soo et al, 1984, Ind. Eng. Chem. Fundam.

Use of Emulsions for Mobility Control During Steamf- (List continued on next page.)

*Primary Examiner*—Richard D. Lovering

*Attorney, Agent, or Firm*—John Wade Carpenter

[57] ABSTRACT

Stable oil-in-water emulsions for pipeline transmission are formed at a temperature of from about 100° F. to about 200° F. preferably using at least one ethoxylated alkylphenol compound and a freezing point depressant for water to enable pipeline transmission at temperatures below the freezing point of water.

45 Claims, 1 Drawing Sheet

U.S. PATENT DOCUMENTS

| | | | |
|---|---|---|---|
| 4,287,902 | 9/1981 | McClaflin et al. | 137/13 |
| 4,333,488 | 6/1982 | McClaflin | 137/13 |
| 4,406,499 | 9/1983 | Yildirim | 299/17 |
| 4,614,236 | 9/1986 | Watkins et al. | 166/304 |
| 4,618,348 | 10/1986 | Hayes et al. | 252/312 X |
| 4,627,458 | 12/1986 | Prasad | 137/13 |
| 4,646,771 | 3/1987 | Prasad et al. | 137/13 |
| 4,666,457 | 5/1987 | Hayes et al. | 252/312 X |
| 4,684,372 | 8/1987 | Hayes et al. | 252/312 X |
| 4,725,287 | 2/1988 | Gregoli et al. | 252/312 X |
| 4,736,795 | 4/1988 | Karas | 166/274 |

FOREIGN PATENT DOCUMENTS

| | | |
|---|---|---|
| 1127845 | 7/1982 | Canada . |
| 1135150 | 11/1982 | Canada . |
| 1135644 | 11/1982 | Canada . |
| 1149302 | 7/1983 | Canada . |
| 1157267 | 11/1983 | Canada . |
| 1192743 | 11/1985 | Canada . |
| 1200697 | 2/1986 | Canada . |
| 256979 | 2/1988 | European Pat. App . |
| 261793 | 3/1988 | European Pat. App . |
| 261794 | 3/1988 | European Pat. App . |

OTHER PUBLICATIONS looding by French et al, 1986, Society of Petroleum Engineers.

Crude-Oil-in -Water Emulsions to Improve Fluid Flow in an Oil Reservoir by McAuliffe, 1973, Journal of Petroleum Technology.

The Contribution of Chemistry to New Marangoni Mass-Transfer Instabilities at the Oil/Water Interface by Nakache, 1983, Faraday Discuss Chem. Soc.

Separation of Metal Ions by Ligand-accelerated Transfer through Liquid Surfactant Membranes by Wasan et al, 1984, Faraday Discuss. Chem. Soc.

Transfer of Alkali-metal and Hydrogen Ions across Liquid/Liquid Interfaces Mediated by Monensin, by Koryta et al 1984, Faraday Discuss. Chem. Soc.

Chemical Kinetics and Mechanisms in Solvent Extraction of Copper Chelates by Flett, 1976, Solvent Extraction.

Theory of Oil Detachment from a Solid Surface. In Situ Emulsification and Enhanced Production of Heavy Oils by a Novel Chemical Huff-and-Puff Method by Ostrovsky, 1987, Colloids and Surfaces.

The Use of Oil/Water Emulsions As a Blocking and Diverting Agent by Farouq Ali et al, 1987, Advances in Petr. Recovery and Upgrading Technology.

Heavy and Extra-Heavy Crude Oil-in-Water Emulsions For Transportation: Their Formulation, Formation and Characterization, by Rivas et al, Unitar-/UNDP Information Centre For Heavy Crude and Tar Sands.

Viscous Crude Oil Transportation: The Presentation of Bitumen, Heavy and Extra-Heavy Crude Oil-in-Water Emulsions by Stockwell et al, Unitar/UNDP Information Centre for Heavy Crude and Tar Sands.

Transportation of Viscous Crude Oil-in-Water Emulsions Through Pipes by Layrisse et al, Unitar/UNDP Information Centre for Heavy Crude and Tar Sands.

Chemicals by GAF ®, pp. 11 through 15, 1985.

LOW-TEMPERATURE PIPELINE EMULSION TRANSPORTATION ENHANCEMENT

This is a continuation of application Ser. No. 938,630, filed Dec. 5, 1986, now abandoned.

BACKGROUND OF THE INVENTION

The present invention is directed to novel emulsifiers for use in the production of stable, water-continuous (oil-in-water) emulsions from crudes, tars and bitumens. Of particular emphasis is the formation of emulsions that have long-term stability and more particularly emulsions based on the use of certain novel surfactants to emulsify bitumens obtained from tar sands such as Syncrude bitumen obtained from Athabasca tar sands.

Crudes produced in the field may vary widely in respect to water content which depends in part on the water used to produce a hydrocarbon crude. Where the crude is formed in fields with a strong water drive, the water cut or amount of water associated with the crude produced can be as high as 95% of the total produced stream.

The water present in a produced stream can be classified into two categories: bound water and free water. Bound water is that water which is locked up in the crude as a water-in-oil emulsion. Separating this water from the stream typically requires appropriate heating, mixing and chemical demulsifiers. Free water is that water which is relatively loosely held by the crude and can be removed simply by heating the stream to a suitable temperature.

Certain bitumens or tar sands, by contrast, and are essentially water-free. They disadvantageously have high viscosities; e.g., 20,000 cp at 100° F. and 300 cp at 200° F. This makes their transport at conventional pipelines at ambient temperatures impossible.

The use of a solvent diluent (e.g., 30–50% by volume) is unsuitable due to cost and long-term unavailability of a low-viscosity fluid and the cost of separation and recycle to origin. A need exists to transfer bitumens and other hydrocarbons over long distances by conventional pipeline technology to existing facilities at costs consonant with oil production.

Water-in-oil emulsions have too high a viscosity and normally higher than the dry oil itself. By contrast, oil-in-water emulsions afford viscosities at levels where pipeline transmission is economical. In cold environments, a problem would still exist, however, in phase destabilization, freezing or an increase in viscosity to a level too high for pipeline transmission. The present invention is directed to the solution of this problem.

SUMMARY OF THE INVENTION

According to the invention there is provided oil-in-water emulsions which are stable at low temperatures, e.g., 10°–20° F. or less, and which comprise an oil-in-water emulsion formed using an oil-insoluble emulsifying agent provided by an aqueous emulsifying composition containing from about 0.05 to about 4% by volume emulsifying agent, and in which the formed oil-in-water emulsion contains from about 15 to about 60% by weight of an aqueous phase comprising water and a freezing point depressant for water. The freezing point depressant may be salts, sugars and/or a hydroxy-organic compound which is an alcohol such as glycerol; glycols such as ethylene glycol and propylene glycol; and the like present in an amount sufficient to maintain the mixture at a viscosity sufficently low to allow pipeline transmission at prevailing ambient temperatures. Preferably, the emulsion is broken at destination or second location and the aqueous phase recycled to origin for reuse.

The emulsifying agents used to form the oil-in-water emulsions are substantially oil-insoluble, and are preferably ethoxylated phenols of the general formula:

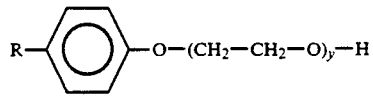

(1)

or

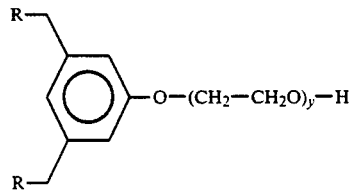

(2)

where each R is independently a hydrocarbon group, preferably an alkyl group, containing from about 8 to about 21 carbon atoms, and y is an integer representing the average of a Gaussian distribution ranging from about 4 to 250. Particularly preferred emulsifying agents are agents where R is $C_9H_{19}$, and y is 40 or 100, and ethoxylated alkyl phenols, where R is $C_{12}H_{24}$, and y is 150 and ethoxylated dialkyl phenols, where each R is $C_9H_{19}$ and y is 150.

Emulsifying composition, i.e. the mixture of water and emulsifying agent or surfactant, is mixed with the hydrocarbon crude at a temperature of from about 100° to about 200° F., preferably, under static shear conditions. The emulsifying composition preferably is an aqueous solution containing from about 0.05 to about 4 volume percent emulsifying agent or surfactant. pH is from about 6 to about 9. Sufficient water, and freezing point depressant as the aqueous phase is present in an amount of from about 15% to about 60% by weight based on the total weight of the emulsifying composition and hydrocarbon. The surfactants useful in the practice of the instant invention may be supplemented by the addition of other surfactants and the emulsion can be stabilized by use of the biopolymer, xanthan. It is preferred that the total surfactant be present in a concentration of from about 25 to about 15,000 ppm based on the weight of the hydrocarbon processed, and that, if employed, the biopolymer xanthan be present in a concentration of from about 25 to about 5,000 ppm by weight of the hydrocarbon.

As compared, hydrocarbons diluted with condensates, e.g., 30% naptha 70% crude, the oil-in-water emulsions offer low viscosities, e.g., 50 to 100 centipoises, as compared to 300 centipoises at 55° F., resulting in greater line capacity. Furthermore, the viscosity of the oil in water emulsions remain constant over the temperature range from about 20° F. to about 200° F. By contrast, the viscosity of the diluent blend although 300 cp at 55° F. increases to about 2000 centipoises or more at 20° F. In addition, there is eliminated the cost and investment to fractionate and recover the condensate for recycle. By contrast, water/freezing point depressant/emulsifying agent mixtures could be recovered by simple heating, and the mixture, to enable economic recycle to origin for reuse.

BRIEF DESCRIPTION OF THE DRAWING

The attached drawing semantically illustrates a preferred process sequence for carrying out the practice of the invention.

DETAILED DESCRIPTION OF THE INVENTION

Figure 1:
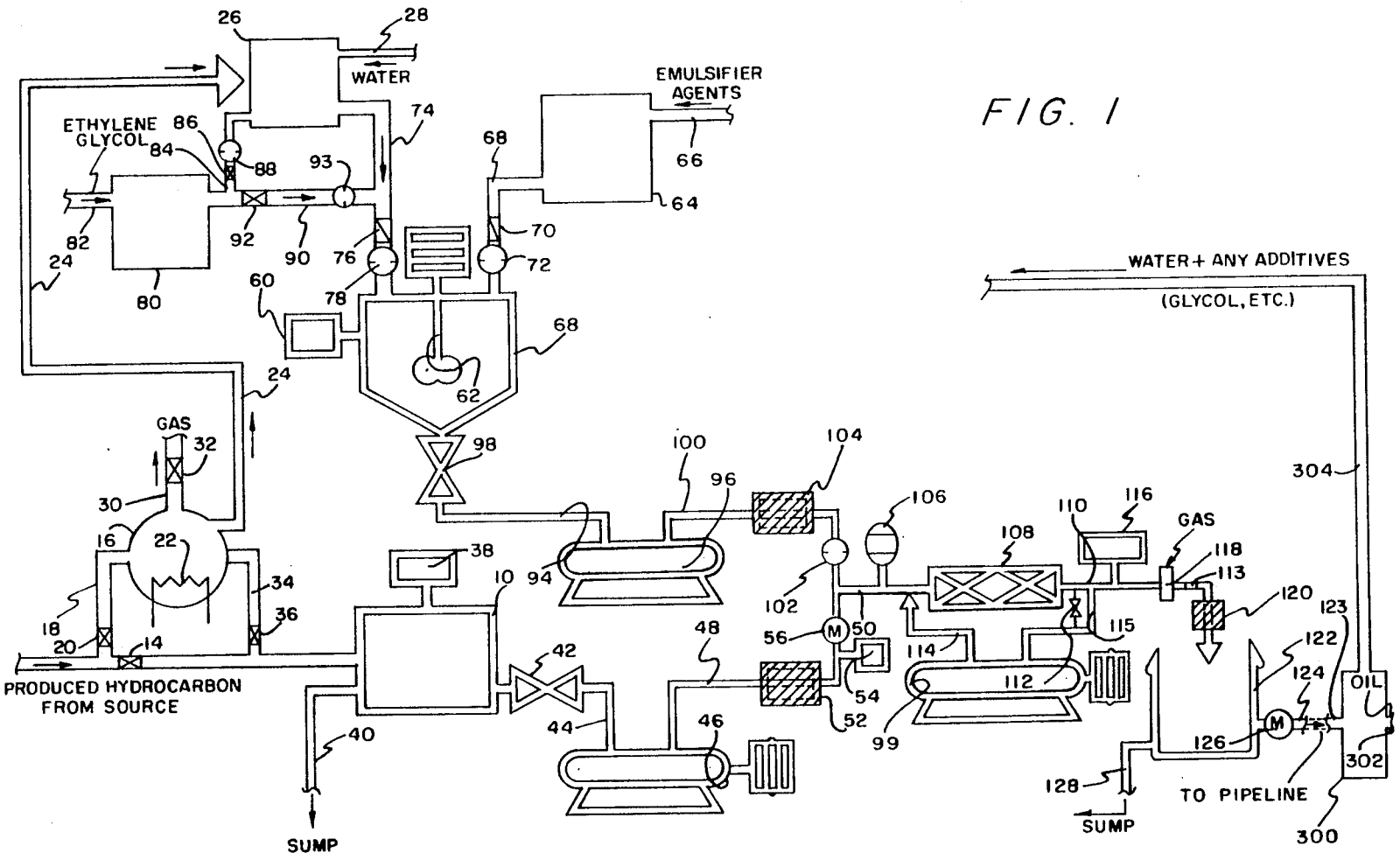

Referring first to the Drawing, there is depicted one system for carrying out the practice of the invention.

With reference thereto, a stream of hydrocarbon is provided from a suitable source, such as a production vat or the like, and is transported into a crude oil tank 10 through a conduit 12. Flow of crude is controlled using valve 14 within conduit 12.

The hydrocarbon may, of course, be any hydrocarbon crude or not which is too viscous for ordinary transportation and generally has a gravity of from about −6 to about 23 degrees API. Included are bitumen, such as Athabasca bitumen, and other hydrocarbon crudes.

The source may also be wells in fluid communication with a subterranean oil reservoir. The producing wells may be under thermal recovery conditions, or the producing wells may be in a heavy oil field where the hydrocarbon crude or oil is being produced from a reservoir having a strong water-drive.

Hydrocarbons produced may be from producing wells using a strong water-drive and include high water-cuts, and appropriate artificial lift systems (e.g., submersible electrical pumps) employed to assist the flow of the hydrocarbon crude because of its high water content.

As will be discussed in greater detail, this invention is particularly suitable for processing of hydrocarbon crudes from the Athabasca tar sands in the province of Alberta, Canada.

No matter what the source of produced hydrocarbon crude, the crude may contain essentially no water, or it may include water in various forms and amounts. The produced crude may also include associated gas. For the purposes of the present invention, it will be assumed that the stream of produced hydrocarbon crude has a low gas to oil ratio.

Any water present in the stream of produced hydrocarbon crude can be classified into two categories: bound water and free water. Bound water is that water which is locked up as water-in-oil emulsions that may be contained in the produced hydrocarbon crude. Separating bound water from the produced hydrocarbon crude typically requires applying the appropriate combination of heat, mixing, and chemical additives. Free water is that water which is relatively loosely held up by the produced hydrocarbon crude and can be removed by merely heating the produced hydrocarbon crude to an appropriate temperature, or providing sufficient residence time in tankage. The quantity of free water which can be removed will depend upon the temperature to which the stream of produced hydrocarbon crude is heated.

In the event that the stream of produced hydrocarbon crude contains a substantial amount of water-in-oil emulsions and/or free water and/or associated gas, the crude may be fed into a free water knock-out unit (FWKO) 16 through a conduit 18 that includes valve 20 to regulate and control the flow of the crude. To accomplish this change in direction of flow of the produced hydrocarbon crude, valve 20 in conduit 18 is opened, and valve 14 in conduit 12 is closed.

The FWKO 16 is operated under pressure and includes heating unit 22 in it which allows the stream of produced hydrocarbon crude to be heated, if required, to any select temperature within the unit design constraints in order to assist in removal of free water and/or associated gas. In the FWKO 16, depending on the temperature, a portion, or substantially all, of the free water will be removed from the stream of produced hydrocarbon crude and can be drained and/or transmitted from the FWKO 16 through a conduit 24 to a water tank 26, which is also in communication with a source of water, brine, or the like through a conduit 28. This water, brine, or the like provides an aqueous phase with which the emulsifying agents of this invention can be mixed to produce the emulsifying compositions of this invention. Any associated gases co-produced with the produced hydrocarbon crude generally, and should, separate out from the stream of produced hydrocarbon crude in the FWKO 16 and vent through a conduit 30 which includes a valve 32. The separated associated gases may be transmitted for further use, or other wise disposed of.

The stream of produced hydrocarbon crude may, if desired, bypass FWKO 16, even if the produced crude contains water-in-oil emulsions and/or free water and/or associated gas.

Pipeline-transportable oil-in-water emulsions may be formulated in accordance with this invention by directly converting, changing, or altering a substantial part of a stream of produced hydrocarbon crude containing, or free of, water-in-oil emulsions, with or without free water, and with or without associated gases, into pipeline-transportable oil-in-water emulsions.

To facilitate the formulation of such pipeline-transportable oil-in-water emulsions, there may be occasions where it is desirable to use the FWKO 16, such as when the produced hydrocarbon crude contains extremely high cuts of free water and/or associated gases.

The FWKO 16 is an optional piece of equipment, especially when Athabasca bitumen is being processed to formulate an oil-in-water emulsion for pipeline transportation. Athabasca bitumen contains essentially no associated gases and no water in any form, such as free water and/or water-in-oil emulsions wherein the contained water is bound water.

The effluent from the FWKO 16, if employed, may be essentially a mixture of water-in-oil emulsions and residual free water, if any. The effluent exits the FWKO 16 through a conduit 34 which, as illustrated, is in communication with the conduit 12. Conduit 34 contains a valve 36 which controls and regulates the flow of the effluent from the FWKO 16 through conduit 34 and into conduit 12, where it is transported into the crude oil tank 10. The emulsifying compositions of this invention, alone or in combination with other operations, will generally produce pipeline-transportable oil-in-water emulsions independent of any water-in-oil emulsions and/or "free" water and/or associated gases contained within the stream of produced hydrocarbon crude.

Crude oil tank 10 has a temperature indicator 38 to monitor the temperature of the produced hydrocarbon crude. Crude oil tank; 10 also includes drain 40 which can drain off to sump (not shown) extra water (if desired) which settles to the bottom of the crude oil tank 10. When pipeline-transportable oil-in-water emulsion is to be formed in accordance with the principles of this invention, valve 42 in conduit 44, which is in communication with the crude oil tank 10, is opened, and crude oil pump 46 may be energized to transport produced hydrocarbon crude through a conduit 48 for eventual mixing, commingling, adding, or the like with the emulsifying composition at the entrance of conduit 50. It should be understood that, while the mixing or adding of the produced hydrocarbon crude with the emulsifying composition is being represented as taking place at the entrance of conduit 50, other systems and/or means of mixing or adding together the produced hydrocarbon crude with the emulsifying composition are within the spirit and scope of this invention. For example, if conduit 50 is a straight-line extension of conduit 48 and integral therewith such that conduit 48 does not have a separate identity, the emulsifying composition would be introduced into the conduit 48, either normal to or at an angle thereto. Likewise, a pump (preferably a rotating, e.g., centrifugal, pump) may be positioned in conduit 50 to further or additionally mix the produced hydrocarbon crude with the emulsifying composition.

As the produced hydrocarbon crude is being pumped by pump 46 through the conduit 48, it passes through a heat exchanger 52 to either heat or cool the crude to a temperature such that, when the produced hydrocarbon crude is mixed with or added to the emulsifying composition, the temperature of the crude-emulsifying composition mixture is from about 100° F. to about 200° F., preferably from about 130° F. to about 170° F., as the pipeline-transportable oil-in-water emulsion is to be formed at these temperatures. It is the temperature of the mixture of the produced hydrocarbon crude plus emulsifying composition that should be at a temperature of from about 100° F. to about 200° F., and not the produced hydrocarbon crude alone. Certain produced hydrocarbon crudes, such as Athabasca bitumen from the Athabasca tar sands, may have a temperature well above 200° F. when processed from the crude oil tank 10. In such instances, and depending on the temperature of the emulsifying composition, heat exchanger 52 may function as a cooling unit to cool down the crude such that the mixture of crude and emulsifying composition would possess the required temperature, namely from about 100° F. to about 200° F., as previously indicated, when the oil-in-water emulsion is formed.

Temperature indicator 54 monitors the temperature of the stream of produced hydrocarbon crude as it exits heat exchanger 52 and flows through conduit 48. The rate of flow through conduit 48 is monitored either by a meter 56 and/or the pumping speed of pump 46. Meter 56 may also include a cut monitor and a sampler to monitor the composition of the stream of hydrocarbon crude with respect to "free" water content, water-in-oil emulsions, and associated gases.

The emulsifying composition is formed or produced in the emulsifying composition tank 58, which comprises a temperature indicator 60 to monitor the temperature of the emulsifying composition and a paddle-wheel mixer means 62 to homogenize, and maintain homogenized, the emulsifying composition. The emulsifying composition of this invention preferably comprises at least one emulsifying agent present in an aqueous medium which comprises water. Salts and other ingredients can be present. Optionally, one or more compounds serving as the freezing point depressants for the emulsion, preferably ethylene glycol, may be included in the emulsifying composition or later added.

The compounds which serve as freezing point depressants include salts (NaCl), sugars and hydroxy-organic compounds, which include alcohols such as glycerol; glycols such as ethylene glycol and propylene glycol; and the like. Ethylene glycol is presently preferred. Salt affords the advantage of utilizing brackish waters for the aqueous phase and allowing the aqueous phase to be discarded at destination. Salt concentration of the brine may be in excess of 15% by weight and up to saturation depending on the hydrocarbon processed.

The amount of freezing point depressant used is that sufficient to maintain the oil-in-water emulsion pumpable at operating temperature, i.e., about 10° to 20° F. or less, but insufficient to cause a permanent loss of the emulsion. Hydroxy-organic compound can generally be used in concentration of up to about 60% by volume of the mixture of hydroxy organic compound and water. For alcohols and glycols, a preferred range is from about 25 to about 50% by volume for higher concentrates, i.e., 67% by volume a reduction in emulsion quality occured. High concentrations, i.e., approaching 50% by volume, may be necessary at temperatures of 15° F. or less where long pipeline residence times are to be experienced.

The emulsifying agents used to form the oil-in-water emulsions are substantially oil-insoluble, and are preferably ethoxylated phenols of the general formula:

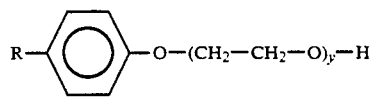

(1)

or

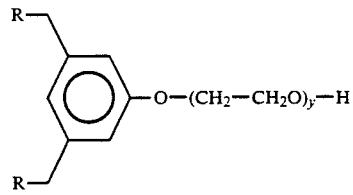

(2)

where each R is independently a hydrocarbon group, preferably an alkyl group, containing from about 7 to about 21 carbon atoms, and y is an integer representing the average of a Gaussian distribution ranging from about 4 to 250.

The presently preferred emulsifying agents employed in the practice of this invention comprise at least one nonionic ethoxylated alkylphenol having the general formula:

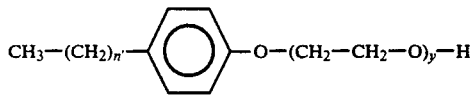

(3)

where n' is from about 7 to about 20, preferably about 11, and y is greater than 100 and up to about 250, preferably from about 125 to about 250, more preferably about 150; and/or an ethoxylated dialkylphenol of the formula:

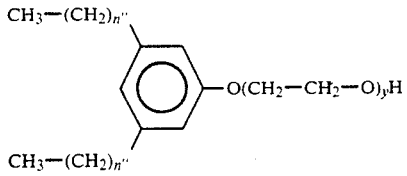

(4)

wherein each n'' is independently from about 7 to about 18, preferably about 8, and y is greater than 100 and up to about 250, preferably about 125 to about 250, more preferably about 150; both of which are substantially oil-insoluble. In the formulas, y represents an average value representative of the midpoint of a Gaussian distribution of ethylene oxide units coupled by polymerization in formation of the emulsifying agents.

More preferably, the nonionic oil-insoluble emulsifying agents of this invention is a combination of the compounds having the general formula (3) and the compounds having the general formula (4), with the compounds having the general formula (4) being at least about 40% by weight of the combination. It is presently preferred that the compounds having the general formula (4) be from about 50% by weight to about 85% by weight of the combination.

The nonionic emulsifying agents of this invention may be used alone or in conjunction with other surfactants. Other surfactants include compounds of the formula:

$$(CH_2-CH_2-O)_x-(CH_2-CHCH_3O)_p(CH_2-CH_2-O)_z H \quad (5)$$

where x and z are the same or different, normally the same and range from about 10 to about 125, and p is from about 25 to about 30. Again, the supplemental surfactants are oil insoluble and introduced as part of an aqueous media. Anionic and cationic surfactants may also be employed.

Oil-in-water emulsions that are produced or formulated with the nonionic emulsifying agents represented by the general formula (1) and/or the general formula (2) can be formed by means of agitation, including dynamic and static shearers and mixers, with static mixing preferred.

The emulsifying agents used in the practice of the invention must enable formation of the oil-in-water emulsion at elevated temperatures and retention of stability at ambient temperatures. Unless broad-based for such functionality, a mixture of two or more emulsifiers is employed and is presently preferred.

In order to form a more stable oil-in-water emulsion (or water-continuous emulsion), especially when the produced hydrocarbon crude is Athabasca bitumen, the water preferably has a pH above about 7, preferably from about 8 to about 13. For other hydrocarbons, pH can be as low as about 4. This is especially true for when brine is employed as the aqueous media. If brine is being utilized, salinity becomes another factor. It has been found that with brine as the aqueous media or additive used for the produced hydrocarbon crude, the salinity of the brine should be at least about 0.1% by weight salt (i.e. NaCl). It should be pointed out that, while no upper limit on salt concentration has been determined, and may be that quantity of salt which supersaturates the brine, or that upper a mount of salt which goes into solution. Preferably, the upper limit is about 3% by weight salt.

More stable oil-in-water emulsions are formed, especially again for when the produced hydrocarbon crude is Athabasca bitumen, under less than ideal agitating conditions, with the use of the biopolymer xanthan, which is an additional stability enhancer. Biopolymer xanthan is added to the emulsifying composition such that the emulsifying composition and/or the water-continuous phase of the oil-in-water emulsion such that the oil-in-water emulsion comprises biopolymer xanthan in a ratio of from about 100 ppm to about 5,000 ppm by weight of the hydrocarbon crude. Stated alternatively, biopolymer xanthan is provided in a concentration of from about 25 to about 5,000 ppm by weight of the produced hydrocarbon crude.

Xanthan has outstanding resistance to shear degradation and is insensitive to waters with high salt content. Xanthan contains D-glucose, D-mannose, and D-glucuronic acid. It is believed to have a cellulose-like backbone composed of repeating B-D(1–4) glucose units with mannose and glucuronic acid present in side chains, and mannose partially modified with acetyl and pyruvate ketol groups.

Xanthan molecular weight is reported to be greater than one million. It likely exists in solution as a helix in native form. The presently accepted structure for xanthan is as follows:

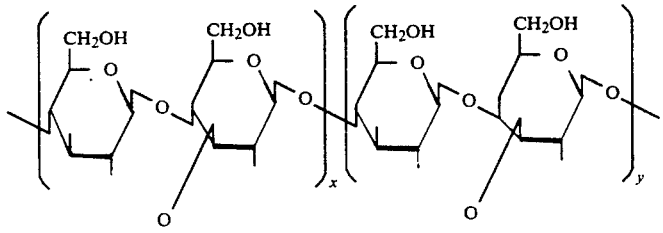

-continued

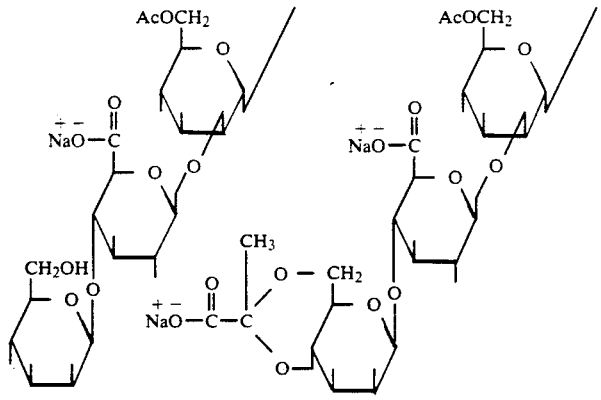

Biopolymer xanthan may be purchased commercially as FLOCON$^R$ Biopolymer 4800 from Pfizer Inc.

The emulsifying agents of this invention and any stabilizer, if used, are introduced into an emulsifying tank 64 through a conduit 66 and dispensed into tank 58 through a conduit 68. Conduit 68 includes valve 70 and flow meter 72 to regulate and meter, respectively, the flow of the emulsifying agent through the conduit 68. The amount of emulsifying agent used in the present invention may range from about 25 to about 15,000 or more ppm weight-to-weight of the produced hydrocarbon crude, preferably from about 500 to about 5,000 ppm by weight. Stated alternatively, the emulsifying composition preferably comprises from about 0.05 vol.% to about 0.1 vol.% of the emulsifying agent.

If the produced hydrocarbon crude bypasses the FWKO 16, the actual water content of the produced hydrocarbon crude may vary widely. It may contain up to about 95% by volume water, or it may be a relatively dry oil containing less than the amount of water required to form a low-viscosity oil-in-water emulsion that is pipeline-pumpable. The object is to provide an oil-in-water emulsion containing from about 15% by weight to about 60% by weight water, preferably from about 20% by weight to about 40% by weight water. To accomplish this objective, water tank 26 is used to furnish water recovered from the as-received stream of produced hydrocarbon crude by separation in FWKO 16 (which is optional), or water externally derived from a source which is introduced into water tank 26 through conduit 28, to provide the aqueous phase for the emulsifying agent to form the emulsifying composition and to adjust the water content of the eventually-produced oil-in-water emulsions for a more effective viscosity for pipeline pumping. Consequently, the amount of emulsifying agent added from emulsifier tank 64 is controlled so as to form a generally stable oil-in-water emulsion of a water concentration suited for low-viscosity pipeline pumping Any extra water will be loosely bound and should separate easily on keeping the stream quiescent. Excess emulsifying agent is to be avoided in order to prevent the binding up and inclusion of too much water in the oil-in-water emulsion and thereby increase, despite low viscosity, energy requirements for transportation. The introduction of too little emulsifying agent is to be avoided because, although there may be formed an initial complete oil-in-water emulsion, it will not be sustained at ambient temperatures, as is required for pipeline transportation. However, the employment of too little emulsifier agent, or not enough emulsifier agent, for transportation through a long pipeline (such as over 1,000 miles long), is not critical because one of the features of this invention is that, although the formulated oil-in-water emulsion may fail and/or break down in a pipeline into a mixture comprising an at least partially (i.e., partially or substantially) coalesced oil droplet phase and residual oil-in-water emulsion, the resulting mixture has a viscosity that is less than, or equal to, the viscosity of the original oil-in-water emulsions, notwithstanding the fact that the at least partially coalesced oil droplet phase itself has a viscosity larger than the viscosity of the original oil-in-water emulsion. In sum, if there is a breakdown in the pipeline into a mixture comprising an at least partially coalesced oil droplets and residual oil-in-water emulsion, it is done without a substantial proportion of the formulated oil-in-water emulsion being inverted into a water-in-oil emulsion. These features enable the mixture of coalesced oil droplets and residual oil-in-water emulsion to be continuously transported through the pipeline without having removed the mixture to reformulate the oil-in-water emulsion.

A conduit. 74 transports water from the water tank 26 into the tank 58, wherein water and the emulsifying agent are mixed or combined together. Valve 76 and flow meter 78 are in conduit 74 to control and meter the flow of the water. It is essential that the emulsifying agents of this invention be mixed or combined with water prior to addition to the mixing with the hydrocarbon crude. If water is absent from the emulsifying composition, and the emulsifying agent in a pure or relatively pure state contact and/or mix with the produced hydrocarbon crude, pipeline-transportable oil-in-water emulsion can be formed, if at all, only with difficulty, even if water is added separately to the produced hydrocarbon crude, or the crude contains water in any of its various forms. The emulsifying agents of this invention are insoluble in hydrocarbon crude and would not form a homogeneous solution with the hydrocarbon crude. Also, unless water is present with the emulsifying agents of this invention, diffusion of the emulsifying agent through the hydrocarbon crude to the interface of the crude and water, which was separately added or already contained within the crude, is much too slow, if at all. This is especially true for Athabasca bitumen. Therefore a salient feature of this invention is the mixing of the emulsifying agent with water prior to any emulsifying agent contacting the produced hydrocarbon crude. To achieve proper emulsification, the emulsifying agents or surfactants are provided in an aqueous solution preferably at a total concentration of about 0.05 to about 4 volume percent.

As was previously mentioned, a suitable freezing point depressant may be mixed with the water to lower the freezing point of the water and/or the emulsifying composition and/or the formed oil-in-water emulsion. For the purposes of illustrating this, ethylene glycol will be employed as the freezing point depressant. To accomplish the mixing of the freezing point depressant, conduit 82 supplies ethylene glycol tank 80 with ethylene glycol. Ethylene glycol can be introduced directly into the water tank 26 through a conduit 84 that contains a valve 86 for regulating the flow of ethylene glycol therethrough. A flow meter 88 is also provided within conduit 84 to monitor the direct flow of ethylene glycol into water tank 26. Alternatively, ethylene glycol can be introduced directly through a conduit 90 into water that is flowing within conduit 74 from the water tank 26. Similar to conduit 84, conduit 90 is provided with valve 92 and flow meter 93 to regulate and meter, respectively, the flow of ethylene glycol through conduit 90. To effect the flow of ethylene glycol through conduit 84, valve 86 in conduit 84 is opened and valve 92 in conduit 90 is closed; and to effect the flow of ethylene glycol through conduit 90, valve 92 in conduit 90 is opened and valve 86 in conduit 84 is closed. Optionally, to accomplish the purpose of using ethylene glycol, instead of introducing and mixing directly the ethylene glycol with the water, ethylene glycol may be introduced into, and mixed directly with, the emulsifying agent, or with the mixture of water and emulsifying agent within tank 58.

The emulsifying composition of this invention is pumped out of tank 58 through a conduit 94 by an emulsifying composition pump 96. Before commencing the pumping of the emulsifying composition through the conduit 94 with the pump 96, valve 98 at the bottom of the tank 58 and within the conduit 94 is opened. Emulsifier composition pump 96 further pumps or transports the emulsifying composition through a conduit 100 to meet with, combine, or mix with, or the like the stream of produced hydrocarbon crude at the entrance of the conduit 50. Conduit 100 is provided with a flow meter 102 to monitor and indicate the flow of the emulsifying composition en route to combining with the produced hydrocarbon crude. Conduit 100 passes through a heat exchanger 104, which is provided in order to control and provide the emulsifying composition with a sufficient temperature such that, when it meets and mixes with the produced hydrocarbon crude at the entrance to conduit 50, the temperature of the mixture of emulsifying composition and produced hydrocarbon crude within conduit 50, is from about 100° F. to about 200° F. Maintaining the temperature of the mixture of emulsifying composition and produced hydrocarbon crude from about 100° F. to about 200° F. is important in order to form the oil-in-water emulsion, as well as to produce and/or maintain a viscosity of the mixture that enables the mixture to be pumped or transported through a pipeline. This is especially true when the produced hydrocarbon crude is Athabasca bitumen, which may at times possess a temperature above 200° F. and/or a high viscosity (e.g., 20,000 cp at about 100° F.) that would render it difficult to pump or transport through a pipeline. Thus, heat exchanger 104, depending on the temperature of the produced hydrocarbon crude at the temperature indicator 54 and/or the temperature of emulsifying compositions from tank 58, may at times have to heat the emulsifying composition; and at other times may have to cool the emulsifier composition instead of heating it, in order that the mixture of produced hydrocarbon crude and emulsifying composition possesses the appropriate temperature of from about 100° F. to about 200° F.; more preferably from about 160° F. to about 195° F. when the produced hydrocarbon crude is Athabasca bitumen, because of the high viscosity factor of the Athabasca bitumen.

The pressure and velocity of the mixture of emulsifying composition and produced hydrocarbon crude is monitored as it travels through conduit 50 by a pressure and velocity monitor 106. Conduit 50 leads or terminates into a mixing device, preferably a static shearing and static mixing means or device, generally illustrated as 108, which produces the oil-in-water emulsion when the mixture is passed at a certain velocity therethrough and at a temperature of from about 100° F. to about 200° F.

The mixture of produced hydrocarbon crude and emulsifying composition may pass through the mixing device 108 at any suitable velocity as the oil-in-water emulsions of the present invention may be formed or produced under laminar or turbulent flow conditions. However, in a preferred embodiment of the present invention, crude oil pump 46 and emulsification composition pump 96 should be fixed or set such that, when the mixture of emulsifying composition and produced hydrocarbon crude enters the mixing device 108, the velocity of the mixture is from about 20 in./sec. to about 140 in./sec., more preferably from about 35 in./sec. to about 115 in./sec. The viscosity of the mixture may be any viscosity that enables the mixture to be pumped, but is preferably from about 100 cp. to about 10,000 cp. at a 20 in./sec. to 140 in./sec. velocity. Depending on the viscosity of the mixture, the pressure of the mixture within conduit 50 is from about 10 psig. to about 150 psig.

Mixing device 108 simultaneously shears and mixes the mixture of emulsifying composition and the produced hydrocarbon crude together when the mixture is at a temperature of from about 100° F. to about 200° F. to form the pipeline-transportable oil-in-water emulsions. The objective of mixing device 108 is to coalesce all the water present, including any water that might be present in the produced hydrocarbon crude as water-in-oil emulsion and/or as free water, into one continuous phase and simultaneously disperse all the oil in the form of small droplets in this continuous-water phase. Water, if any, present in the produced hydrocarbon crude in the form of water-in-oil emulsion and/or free water is converted, changed, or altered in mixing device 108 into an oil-in-water emulsion. Mixing device 108 is preferably a cylindrical static mixing device with any suitable diameter, such as from about 0.2 inch to about 6.0 feet.

The effluent mixing device 108 is discharged into a conduit 110 and is substantially a water-external, oil-in-water emulsion that is suitable for pipeline transportation However, this oil-in-water emulsion may contain extra water relative to that required to achieve a certain pipeline viscosity. Sampler 112 is provided within conduit 110 such that the oil-in-water emulsion leaving the mixing device 108 to sample the quality of oil-in-water emulsion achieved, including any water-in-oil emulsion that might have been initially contained within the produced hydrocarbon crude and subsequently converted or changed into an oil-in-water emulsion. Conduit 110 also includes valve 113 for regulating or terminating the flow of oil-in-water emulsions therethrough.

If needed, and optionally, the formulated oil-in-water emulsions can be recycled through a line 114, using a recycle pump 99, and back to the point of where the mixture of emulsifying composition and produced hydrocarbon crude is introduced into mixing device 108 to ensure formation of proper oil-in-water emulsion. To accomplish this recycle operation, recycle pump 99 is energized after valve 113 in conduit 110 is closed, and a valve which is normally closed in conduit 114 is opened. A temperature indicator 116 is provided in conduit 110 to monitor the temperature of the oil-in-water emulsions flowing therethrough. Optionally, degassing boot: 118 may also be provided in conduit 110 if degassing of the oil-in-water emulsions is desired or needed.

After degassing boot 118, the pipeline-transportable oil-in-water emulsion flows through a heat exchanger 120 and into an emulsion tank 122, or directly to a pipeline 123. Heat exchanger 120 is used to cool the oil-in-water emulsion flowing through conduit 110 to a temperature of about 120° F. or below, preferably below about 100° F., and more preferably from about 80° F. to about 100° F. The oil-in-water emulsions of this invention are temperature-sensitive. At high temperatures (i.e., above about 120° F.), the oil-in-water emulsion has low stability. At temperatures below about 120° F., the stability of the oil-in-water emulsions of this invention increases. Thus, to achieve a more stable oil-in-water emulsion, the temperature of the oil-in-water emulsion flowing through the conduit 110 should be lowered below about 120° F.

In the emulsion tank 122, the pipeline-transportable oil-in-water emulsion is ready to be transmitted or transported through a conduit 124 to the pipeline 123. The quality of the oil-in-water emulsion may be checked by another meter 126 having a cut monitor and sampler, and, if satisfactory, it is sent to the pipeline 123 for transportation to a desired destination. Optionally, and if necessary, the oil-in-water emulsion, before transmission to pipeline 123, may remain for a certain period of residence time in the emulsion tank 122 in a quiescent enough environment such that all of the extra water (if any) will settle down to the bottom of the emulsion tank 122 so that the effluent oil-in-water emulsion will contain a more appropriate amount of water necessary from a pipeline-viscosity standpoint. The extra water (if any) settling to the bottom of the emulsion tank 122 can be drained off through conduit 128 to a sump.

It should be noted that as long as the temperature of the oil-in-water emulsion within the emulsion tank 122 is below about 120° F., there should be no problems with the oil-in-water emulsion with respect to stability. Similarly, as long as the quantity of water in the effluent oil-in-water emulsion is greater than what is needed, there should be no problems with the oil-in-water emulsion with respect to pipeline-viscosity standpoint, especially for Athabasca bitumen. Excess water in the oil-in-water emulsion is of no major concern when the oil-in-water emulsion is to be transported through a pipeline that is not too long, such as one to two miles. However, excess water for a long pipeline should not be too large because there may be limitations in the pipeline from a pumping-capacity standpoint. There may be a problem, especially when the produced hydrocarbon crude is Athabasca bitumen, if the amount of water in the effluent oil-in-water emulsion is less than what is required from an effective pipeline-viscosity standpoint. Once the amount of water in the formulated oil-in-water emulsion is the appropriate amount for effective pipeline-viscosity standpoint, the formulated oil-in-water emulsion may be pumped or transported through a pipeline of any length, such as over 1,000 miles, without concern about the formulated oil-in-water emulsion failing and/or breaking down into a mixture or phases that do not possess an effective viscosity for pipeline transportation.

After the oil-in-water emulsion has been transported or pumped through the pipeline 123 to its final destination, the oil droplets are separated from the oil-in-water emulsion in a separating station 300 that is positioned at the end of the pipeline 123. The separated oil leaves the separating station through pipeline 302. If the distance is short, the residual water product after the oil has been separated, which is water plus any additives (e.g., ethylene glycol, etc.), could be recycled back through conduit 304 to the water tank 26, or the tank 58, in order to be admixed with the produced hydrocarbon crude as long as the water is discarded.

Separating the oil droplets from the oil-in-water emulsion may be accomplished by any suitable means, such as heating the oil-in-water emulsion above the phase inversion temperature (P.I.T.), which is generally from about 180° F. to about 210° F., and/or adding demulsifiers. Any demulsifiers added to the oil-in-water emulsion, and contained within the residual water product after the oil has been separated, has little or not effect on the emulsifying agents of this invention.

Alternative to separating the oil droplets from the oil-in-water emulsion, the existing oil-in-water emulsion can be used in its existing state, such as for fuel, and there would be no need to separate the oil droplets from the existing oil-in-water emulsion. Thus, in those instances where the oil-in-water emulsion is to be burned as fuel, the oil-in-water emulsion can be fed directly to a boiler (e.g., utility boiler, fluidized bed boiler, etc.). No separation step would have to be employed unless the BTU content of the oil-in-water emulsion is too low.

EXAMPLE 1

There was employed Manatoken crude in forming an oil-in-water emulsion in which the water-continuous (3% brine) phase containing as an emulsifier composition comprising an aqueous solution of equal parts of the surfactants:

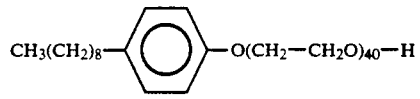

(NP-40)

and

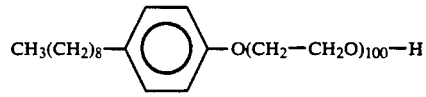

(NP-100)

present in a total concentration of 1,000 ppm. Emulsions formed with 33% and 50% ethylene glycol in the continuous phase were fully compatible. At 67% emulsion quality was poor. Emulsions containing 33% and 50% ethylene glycol were subjected to a temperature of 14° F. for 24 hours. The emulsion containing 33% ethylene glycol was thick but not frozen and was redispersable in water. The emulsion containing 50% ethylene glycol as compared to the 33% emulsion did exhibit brine drop-out but the brine phase remained fluid and the emulsion could be redispersed with simple shaking.

The emulsions were more viscous but remained sufficiently fluid to enable transmission. They were equally stable at 70° F.

EXAMPLE 2

The oil sample was Athabasca bitumen. The aqueous phase was a brine comprising 3% by wt. NaCl. The emulsifying composition comprising the emulsifying agent as an ethoxylated alkylphenol compound having the general formula:

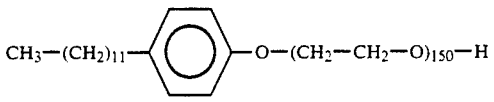

and added to the brine at a concentration of about 1428.6 ppm by weight of Athabasca bitumen. The emulsifying composition was mixed with the Athabasca bitumen at a temperature of about 190° F. ±5° F. The emulsifying-bitumen mixture was placed in a rotor-stator at 3000 rpm for 40 secs. An oil-in-water emulsion is produced containing 50% by volume ethylene glycol in the water-continuous phase and is pipeline transportable at 15° F.

EXAMPLE 3

Example 2 was repeated except that the emulsifying composition comprising the emulsifying agent as an ethoxylated dialkylphenol compound having the general formula:

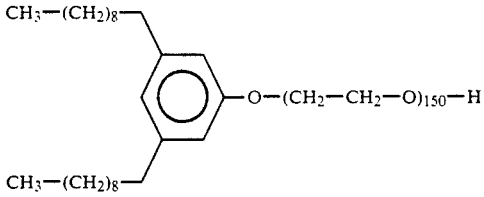

and employed in the brine at a concentration of about 1428.6 ppm by weight of Athabasca bitumen. The emulsifying composition was mixed with the Athabasca bitumen at a temperature of about 190° F ±5° F. The emulsifying-bitumen mixture was placed in a rotor-stator at 3000 rpm for 40 secs. An oil-in-water emulsion(s) was produced with a substantial shear life. Ethylene glycol is present at a concentration of 40% by volume of the brine and the emulsion remains stable and fluid at 10° F.

The crude oil was Athabasca bitumen. The aqueous phase is brine comprising 3% by weight NaCl with a pH of 7.0 to 8.0 mix at 50:50 by volume with ethylene glycol.

The surfactant was a 50:50 mixture of:

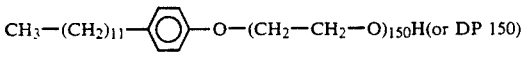

and

-continued

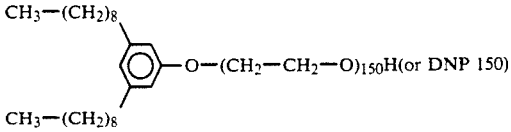

The oil-in-water emulsion formation temperature was 164° F. with a rotor/stator at 3000 rpm for 300 sec. The formed emulsion remains stable and flowable at 15° F.

EXAMPLE 5

Example 1 was repeated except that the aqueous phase was one containing 14 weight percent NaCl. The formed emulsion remained stable and flowable at 20° F.

What is claimed is:

1. A process for preparing an oil-in-water emulsion comprising agitating a hydrocarbon with an emulsifying composition comprising an aqueous phase and a minor amount of an emulsifying agent to form an oil-in-water emulsion, wherein the emulsifying agent comprises an ethoxylated alkylphenol compound having the general formula:

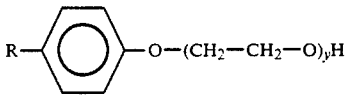

wherein R is a hydrocarbon group and y has an average value greater than 100 and up to about 250 and is representative of the midpoint of a Gaussian distribution of ethylene oxide units coupled by polymerization in formation of the emulsifying agent.

2. A process as claimed in claim 1 in which the emulsifying agent content of the emulsifying composition is from about 0.05 to about 4 volume percent.

3. A process as claimed in claim 1 in which the emulsifying agent content of the formed emulsion is from about 25 to about 15,000 ppm based on the weight of the hydrocarbon.

4. A process as claimed in claim 1 in which the emulsion is stabilized by the presence of a stabilizing amount of the biopolymer xanthan.

5. A process as claimed in claim 4 in which the biopolymer is present in a concentration of from about 25 to about 5000 ppm based on the weight of the hydrocarbon.

6. The process of claim 1 wherein R has the general formula: $CH_3—(CH_2)_n—$ wherein n is an integer having a value of from about 7 to about 20.

7. The process of claim 1 additionally comprising admixing a freezing point depressant with the emulsifying composition in an amount sufficient to lower the freezing point of the formed oil-in-water emulsion and cause the formed oil-in-water emulsion to remain fluid at a select temperature below the freezing point of water.

8. The process of claim 1 wherein said formed oil-in-water emulsion comprises an oil droplet phase dispersed in a water continuous phase, and said process additionally comprises transporting the formed oil-in-water emulsion of claim 1 through a pipeline until a portion of the dispersed oil droplet phase coalesces in the water continuous phase to produce a mixture comprising a coalesced oil droplet phase having a viscosity higher than the viscosity of the formed oil-in-water emulsion of claim 1 and a residual oil-in-water emulsion, without a substantial proportion of said formed oil-in-water emulsion of claim 1 being inverted into a water-in-oil emulsion, and wherein said mixture comprising said coalesced oil droplet phase and said residual oil-in-water emulsion has a viscosity lower than the viscosity of the formed oil-in-water emulsion of claim 1.

9. The process of claim 8 additionally comprises transporting said mixture comprising said coalesced oil droplet phase and said residual oil-in-water of claim 8 through said pipeline.

10. The process of claim 9 additionally comprising separating oil from said mixture comprising said coalesced oil droplet phase and said residual oil-in-water emulsion after said transporting step and subsequently recycling the remaining portion of said mixture after said oil has been removed back to be admixed with additional emulsifying composition for use in preparing additional oil-in-water emulsion.

11. The process of claim 1 wherein said emulsifying agent additionally comprises a second ethoxylated alkylphenol compound having the general formula:

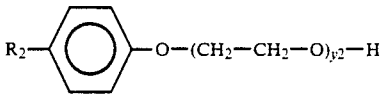

wherein $R_2$ is a hydrocarbon group and $y_2$ is an integer representing the average of Gaussian distribution ranging from about 4 to 250.

12. The process of claim 11 wherein $R_2$ is a nonyl alkyl group and $y_2$ is about 40, and the second ethoxylated alkylphenol compound comprises about 50% by wt. of the emulisfying agent.

13. A process for preparing an oil-in-water emulsion for low-temperature pipeline transmission comprising mixing a hydrocarbon with an emulsifying composition at a temperature of from about 100° F. to about 2100° F. to form an oil-in-water emulsion having a viscosity sufficiently low for pipeline transmission, wherein said emulsifying composition comprising water and oil insoluble emulsifying agents comprising at least one compound having the general formula:

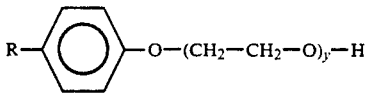

or:

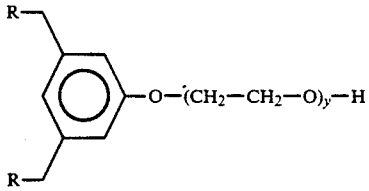

and mixtures thereof, wherein each R is a hydrocarbon group and y is an integer having a value greater than 100 up to about 250, said emulsion having an aqueous phase comprising water and a freezing point depressant for water which is a hydroxyorganic compound, wherein the amount of aqueous phase present is from about 15% to about 60% by weight based on the combined weight of the hydrocarbon and emulsifying composition, and wherein the emulsifying agent is provided in an amount sufficient to form an oil-in-water emulsion that is sufficiently stable for pipeline transmission, and wherein the freezing point depressant is present in an amount sufficient to cause the oil-in-water emulsion to remain fluid at a select temperature below the freezing point of water.

14. A process as claimed in claim 13 in which the freezing point depressant is present in an amount up to about 60 percent by volume of the aqueous phase.

15. A process as claimed in claim 14 in which the freezing point depressant is ethylene glycol.

16. A process as claimed in claim 13 in which the freezing point depressant is ethylene glycol.

17. A process as claimed in claim 13 in which the freezing point depressant is present in an amount of from about 10 to about 50 percent by volume of the aqueous phase.

18. A process as claimed in claim 17 in which the freezing point depressant is ethylene glycol.

19. A process as claimed in claim 13 in which the emulsifying agent content of the emulsifying composition is from 0.05 to about 4 volume percent.

20. A process as claimed in claim 13 in which the emulsifying agent content of the formed emulsion is from about 25 to about 15,000 ppm based on the weight of the hydrocarbon.

21. A process as claimed in claim 13 in which the emulsifying agent comprises a mixture of about 15 to about 60% by weight ethoxylated alkylphenol and about 40 to about 85% by weight ethoxylated dialkylphenol.

22. A process as claimed in claim 13 in which the emulsion is stabilized by the presence of a stabilizing amount of the biopolymer xanthan.

23. A process as claimed in claim 22 in which the biopolymer is present in a concentration of from about 25 to about 5000 ppm based on the weight of the hydrocarbon.

24. A process for preparing an oil-in-water emulsion for low-temperature pipeline transmission comprising mixing a hydrocarbon with an emulsifying composition at a temperature of from about 100° F. to about 200° F. to form an oil-in-water emulsion having a viscosity sufficiently low for pipeline transmission, wherein said emulsifying composition comprises water and an emulsifying agent comprising at least one substantially oil insoluble ethoxylated alkylphenol compound having the general formula:

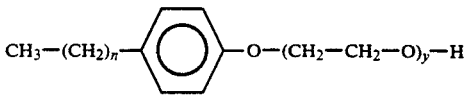

or an ethoxylated dialkylphenol compound having the general formula:

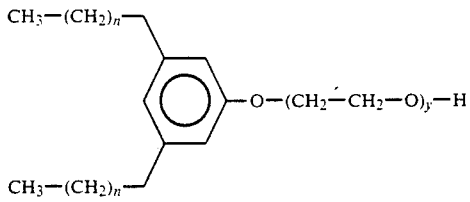

and mixtures thereof wherein each n is an integer having a value of from about 7 to about 21, and y is an integer having a value greater than 100 up to about 250, and in which a continuous aqueous phase is present in an amount of from about 15% to about 60% by weight based on the combined weight of the oil and emulsifying composition, wherein the emulsifying agents are used in an amount sufficient to enable the formation of an oil-in-water emulsion that is sufficiently stable for pipeline transmission, and wherein the aqueous phase contains glycol in an amount of from about 10 to about 50 percent by volume of the aqueous phase.

25. A process as claimed in claim 24 in which the emulsifying agent content of the emulsifying composition is from 0.05 to about 4 volume percent.

26. A process as claimed in claim 24 in which the emulsifying agent content of the formed emulsion is from about 25 to 15,000 ppm based on the weight of the bitumen.

27. A process as claimed in claim 24 in which the emulsion is stabilized by the presence of a stabilizing amount of the biopolymer xanthan.

28. A process as claimed in claim 27 in which the biopolymer is present in a concentration of from about 25 to about 5,000 ppm based on the weight of the hydrocarbon.

29. A process as claimed in claim 24 in which the emulsion is formed under static shear conditions.

30. A process as claimed in claim 24 in which the emulsifying agent comprises a mixture of the ethoxylated alkylphenol and the ethoxylated dialkylphenol.

31. A process as claimed in claim 24 in which the mixture comprises about 15 to 60% by weight ethoxylated alkylphenol and about 40 to about 85% by weight ethoxylated dialkylphenol.

32. A process for preparing an oil-in-water emulsion comprising agitating a hydrocarbon with an emulsifying composition comprising an aqueous phase and a minor amount of an emulsifying agent to form an oil-in-water emulsion, wherein the emulsifying agent comprises an ethoxylated dialkylphenol compound having the general formula:

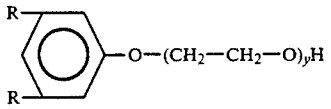

wherein each R is a hydrocarbon group and y has an average value greater than 100 and up to about 250 and is representative of the midpoint of a Gaussian distribution of ethylene oxide units coupled by polymerization in formation of the emulsifying agent.

33. The process of claim 32 wherein each R has the general formula:

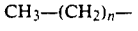

wherein n is an integer having a value of from about 7 to about 20.

34. The process of claim 32 additionally comprising admixing a freezing point depressant with the emulsifying composition in an amount sufficient to lower the freezing point of the formed oil-in-water emulsion and cause the formed oil-in-water emulsion to remain fluid at a select temperature below the freezing point of water.

35. The process of claim 32 wherein said formed oil-in-water emulsion comprises an oil droplet phase dispersed in a water continuous phase, and said process additionally comprises transporting the formed oil-in-water emulsion of claim 32 through a pipeline until a portion of the dispersed oil droplet phase coalesces in the water continuous phase to produce a mixture comprising a coalesced oil droplet phase having a viscosity higher than the viscosity of the formed oil-in-water emulsion of claim 32 and a residual oil-in-water emulsion, without a substantial proportion of said formed oil-in-water emulsion of claim 32 being inverted into a water-in-oil emulsion, and wherein said mixture comprising said coalesced oil droplet phase and said residual oil-in-water emulsion has a viscosity lower than the viscosity of the formed oil-in-water emulsion of claim 32.

36. The process of claim 35 additionally comprises transporting said mixture comprising said coalesced oil droplet phase and said residual oil-in-water of claim 35 through said pipeline.

37. The process of claim 36 additionally comprising separating oil from said mixture comprising said coalesced oil droplet phase and said residual oil-in-water emulsion after said transporting step and subsequently recycling the remaining portion of said mixture after said oil has been removed back to be admixed with additional emulsifying composition for use in preparing additional oil-in-water emulsion.

38. A process for preparing and burning an oil-in-water emulsion comprising the steps of:

(a) agitating a hydrocarbon with an emulsifying composition comprising an aqueous phase and a minor amount of an emulsifying agent to form an oil-in-water emulsion, wherein the emulsifying agent comprises an ethoxylated alkylphenol compound having the general formula:

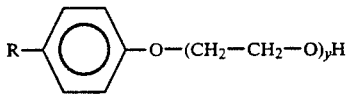

wherein R is a hydrocarbon group and y has an average value greater than 100 and up to about 250 and is representative of the midpoint of a Gaussian distribution of ethylene oxide units coupled by polymerization in formation of the emulsifying agent; and (b) burning the formed oil-in-water emulsion.

39. The process of claim 38 wherein R has the general formula:

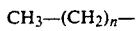

wherein n is an integer having a value of from about 87 to about 20.

40. The process of claim 38 additionally comprising admixing a freezing point depressant with the emulsifying composition in an amount sufficient to lower the freezing point of the formed oil-in-water emulsion and cause the formed oil-in-water emulsion to remain fluid at a select temperature below the freezing point of water.

41. The process of claim 38 wherein said emulsifying agent additionally comprises a second ethoxylated alkylphenol compound having the general formula:

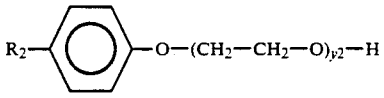

wherein $R_2$ is a hydrocarbon group and $y_2$ is an integer representing the average of a Gaussian distribution ranging from about 4 to 250.

42. The process of claim 41 wherein $R_2$ is a nonyl alkyl group and $y_2$ is about 40, and the second ethoxylated alkylphenol compound comprises about 50% by wt. of the emulsifying agent.

43. A process for preparing and burning an oil-in-water emulsion comprising (a) agitating a hydrocarbon with an emulsifying composition comprising an aqueous phase and a minor amount of an emulsifying agent to form an oil-in-water emulsion, wherein the emulsifying agent comprises an ethoxylated dialkylphenol compound having the general formula:

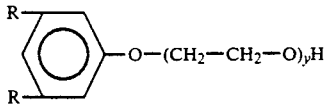

wherein each R is a hydrocarbon group and y has an average value greater than 100 and up to about 250 and is representative of the midpoint of a Gaussian distribution of ethylene oxide units coupled by polymerization in formation of the emulsifying agent; and (b) burning the formed oil-in-water emulsion.

44. The process of claim 43 wherein each R has the general formula:

$$CH_3-(CH_2)_n-$$

wherein n is an integer having a value of from about 7 to about 20.

45. The process of claim 43 additionally comprising admixing a freezing point depressant with the emulsifying composition in an amount sufficient to lower the freezing point of the formed oil-in-water emulsion and cause the formed oil-in-water emulsion to remain fluid at a select temperature below the freezing point of water.

* * * * *